US005154039A

United States Patent [19]

de Guglielmo

[11] Patent Number: 5,154,039

[45] Date of Patent: Oct. 13, 1992

[54] PACKING METHOD AND MACHINE

[76] Inventor: Pascal de Guglielmo, 2, Chemin Des Haies, Montgueux, 10300 Ste Savine, France

[21] Appl. No.: 730,207

[22] Filed: Jul. 15, 1991

[30] Foreign Application Priority Data

Jul. 13, 1990 [FR] France ..... 90 08986

[51] Int. Cl.[5] ..... B65B 27/04; B65B 21/24

[52] U.S. Cl. ..... 53/398; 53/48.7; 53/48.9; 493/387

[58] Field of Search ..... 53/48.7, 48.8, 48.9, 53/398, 462, 207, 590, 49; 493/387

[56] References Cited

U.S. PATENT DOCUMENTS

| | | | |
|---|---|---|---|
| 2,817,197 | 12/1957 | Anness | 53/48.7 |
| 2,917,877 | 12/1959 | Fisher | 53/398 |
| 2,974,454 | 3/1961 | André et al. . | |
| 3,166,879 | 1/1965 | Chidsey, Jr. et al. | 53/48.9 X |
| 3,234,706 | 2/1966 | Arneson . | |
| 3,527,016 | 9/1970 | Doreau | 53/48.7 |
| 4,100,715 | 7/1978 | Ganz | 53/49 X |
| 4,159,609 | 7/1979 | Focke | 53/462 X |
| 4,160,353 | 7/1979 | Ganz | 53/48.7 X |
| 4,571,923 | 2/1986 | Le Bras | 53/398 |
| 5,058,363 | 10/1991 | Focke et al. | 53/462 X |

FOREIGN PATENT DOCUMENTS 0149351 7/1985 European Pat. Off. .

*Primary Examiner*—Horace M. Culver

*Attorney, Agent, or Firm*—Hill, Van Santen, Steadman & Simpson

[57] ABSTRACT

A method and apparatus for packing pots or cups in two rows in a package formed of a jacket characterized by providing a blank having a base panel, a pair of lateral panels connected by fold lines to the base panel and a pair of upper panels connected to the lateral panels by fold lines, said base panel having first and second tabs, first and second lateral parts and a median part having first and second lateral zones and a central zone; relatively folding the blank in the base zone so that the first lateral part and the median part of the base panel are folded relative in a first direction through approximately a quarter of a turn relative to the second lateral part to release the second tabs from the plane of the median part; applying paste to the second tabs; relatively folding by about another quarter of a turn in the same direction in order to bring the second lateral zone of the median part over the first lateral part; relatively folding by about a quarter of a turn in a second direction opposite the first direction in order to bring the first tabs into contact with the second tabs; pressing the first and second tabs mutually together and then relatively folding by about another quarter of a turn in the second direction in order to erect the two lateral zones with respect to the two lateral parts to form a central protrusion for positioning of the pots or cups, which are then located therein and then completing the forming of the package by folding the lateral panels relative to the base panel and then folding and joining the upper panels.

11 Claims, 7 Drawing Sheets

PACKING METHOD AND MACHINE

FIELD OF THE INVENTION

The invention relates to a packing method and a packing machine.

It is more specially applicable to the production of packets each containing pots or cups disposed in two rows side by side and a package forming a jacket surrounding these pots and comprising a base panel having protrusions for strengthening and for positioning the pots, lateral panels and upper panels for covering, which upper panels are rigidly connected with each other.

PRIOR ART

The document EP-A-0,149,351 relates to a method and machine for the production of packets of a similar type. Such a machine comprises: a device for continuously feeding a series of flat packaging blanks; a device for folding and erecting strengthening tabs produced in the base panel of each of the blanks; devices for causing the simultaneous forward movement of two linear series of pots to be packed, each pot being brought above the corresponding blank; a device for bringing each pot into the corresponding opening produced in the base panel; a device for folding the strengthening tabs over the pots; a device for vertically folding the lateral walls and for horizontally folding a first portion of an upper wall; a device for the application of adhesive onto the tabs of this first portion of the upper wall; a device for folding a second portion of the upper wall on top of the first portion; and a device for pressing the two portions, one on top of the other. According to this document the strengthening tabs are separated from each other and are obtained by means of openings pierced in the base panel of the packing blank, these openings serving, in their turn, for receiving the pots and for holding them positioned with respect to each other. Because of this structure it is possible to fold and erect the strengthening tabs by means of a device of the type comprising a rotary element and radially protruding fingers, the rotary element being placed below the plane of travel of the blanks and the fingers passing through the openings in the base panel.

From the document US-A-3,234,706 there is also known a machine for packing cans of preserved food which implements a cutout in cardboard which is originally flat and open; this cutout being provided with parallel transverse folding lines; and this cutout being closed on itself around several cans of preserved food and rigidly connected to itself.

According to the document US-A-3,166,879 a wrap-around machine for cans of preserved food is described in which a cutout is also folded.

The document US-A-2,974,454 also describes a method and an apparatus for packing cans of preserved food.

However, these documents all relate to a technology which is different from that to which the invention relates.

SUMMARY OF THE INVENTION

The purpose of the invention is to produce a package of the general type mentioned in the preamble, having strengthening and positioning protrusions in the form of a longitudinal and continuous beam adjoining the base panel, in its median part and passing at right angles to transverse tabs cut out in the base panel and facing each other, superimposed and joined together in pairs.

Another purpose of the invention is to obtain such packages from blanks which are only cut out and flat, the beams not yet being constituted, on a single machine or line on which the production of the beams, the positioning of the pots or cups and the closing of the package on itself are carried out simultaneously.

Another purpose of the invention is to achieve high rates with good reliability and with satisfactory economic conditions without affecting, on the contrary, the quality of the packages produced and the safety of the operation.

These purposes are achieved by a machine for packing cups or pots arranged in two rows, in a package forming a jacket which comprises connected to each other by longitudinal folding lines:

(i) a base panel having rigidifying and pot positioning protrusions;

(ii) adjoining lateral panels;

(iii) adjoining upper panels for covering and rigidly joined together;

this machine comprising:

a) transfer means for feeding unfolded flat packing blanks and mobile means for the horizontal transfer of successive blanks;

and, associated from upstream to downstream along the transfer means:

b) a device for folding and erecting rigidifying and positioning protrusions;

c) means for bringing two series of pots operating in synchronism with the transfer means from a supply of pots to a location close to the transfer means in order to bring the pots to be on the adjacent base panels and on either side of the rigidifying and positioning protrusions;

d) means for folding lateral panels to a generally erected position against the pots;

e) means for folding and of joining together the upper panels;

in which the device for folding and erecting the rigidifying and positioning protrusions comprises, placed along the transfer means:

an initial station for folding by about a quarter of a turn in a first direction in order to bring a first lateral part and the median part of the base panel into a generally erected position and to thus release second tabs extending the second lateral part of the base panel;

a tab pasting station;

a second station for folding by about a quarter of a turn in the first direction in order to bring a second lateral zone of the median part into a generally horizontal position over the second lateral part;

a third station for folding by about a quarter of a turn in a second direction in order to bring the first lateral part, the central zone and the first lateral zone of the median part into a generally horizontal position, the first tabs coming into contact with the second tabs;

a station for the mutual pressing of the first and second tabs;

a fourth and final station for folding by about a quarter of a turn in the second direction in order to bring the two lateral zones of the median part into a generally vertical position.

According to another aspect, the invention also relates to a device for producing a beam on a packing blank, which comprises:

transfer means for feeding unfolded flat packing blanks and mobile means for the horizontal transfer of successive blanks;

and, associated along the transfer means:

an initial station for folding by about a quarter of a turn in a first direction in order to bring a first lateral part and a median part of a base panel of a blank into a generally erected position and to thus release second tabs extending a second lateral part of the base panel;

a tab pasting station;

a second station for folding by about a quarter of a turn in the first direction in order to bring a second lateral zone of the median part into a generally horizontal position over the second lateral part;

a third station for folding by about a quarter of a turn in a second direction in order to bring the first lateral part, the central zone and the first lateral zone of the median part into a generally horizontal position, the first tabs coming into contact with the second tabs;

a final station for the mutual pressing of the first and second tabs.

This device can be incorporated in an installation for the packing of pots arranged in two rows in a package forming a jacket having a beam for rigidifying and for positioning the pots, furthermore comprising a device for the packing of pots with the previously prepared blanks, itself comprising:

a) mobile means for the horizontal transfer of successive blanks provided with the folded beam;

and associated from upstream to downstream along the transfer means:

b) a device for erecting the beam;

c) means for bringing two series of pots operating in synchronism with the transfer means from a supply of pots to a location close to the transfer means in order to bring the pots to be on the adjacent base panels and on either side of the beam;

d) means for folding lateral panels to a generally erected position against the pots;

e) means for folding and of joining together the upper panels.

According to another aspect, the invention relates to a method for producing a beam projecting from a packing blank in which:

firstly a relative folding by about at least a quarter of a turn is carried out in a first direction, of a lateral part and of a median part of a base panel of the blank, and second tabs are released extending a second lateral part of the base panel;

the tabs are then pasted;

a relative folding by about at least a quarter of a turn is carried out in the first direction in order to bring a second lateral zone of the median part over the second lateral part;

a relative folding by about at least a quarter of a turn is carried out in a second direction opposite to the first direction in order to bring the first tabs into contact with the second tabs;

the first and second tabs are mutually pressed in order to ensure their joining together;

a relative folding by about at least a quarter of a turn is carried out in the second direction in order to erect the two lateral zones with respect to the two lateral parts.

BRIEF DESCRIPTION OF THE DRAWINGS

The other features and advantages will emerge from the following description of a possible embodiment given with reference to the appended drawings in which.

DESCRIPTION OF THE PREFERRED EMBODIMENTS

Figure 3:
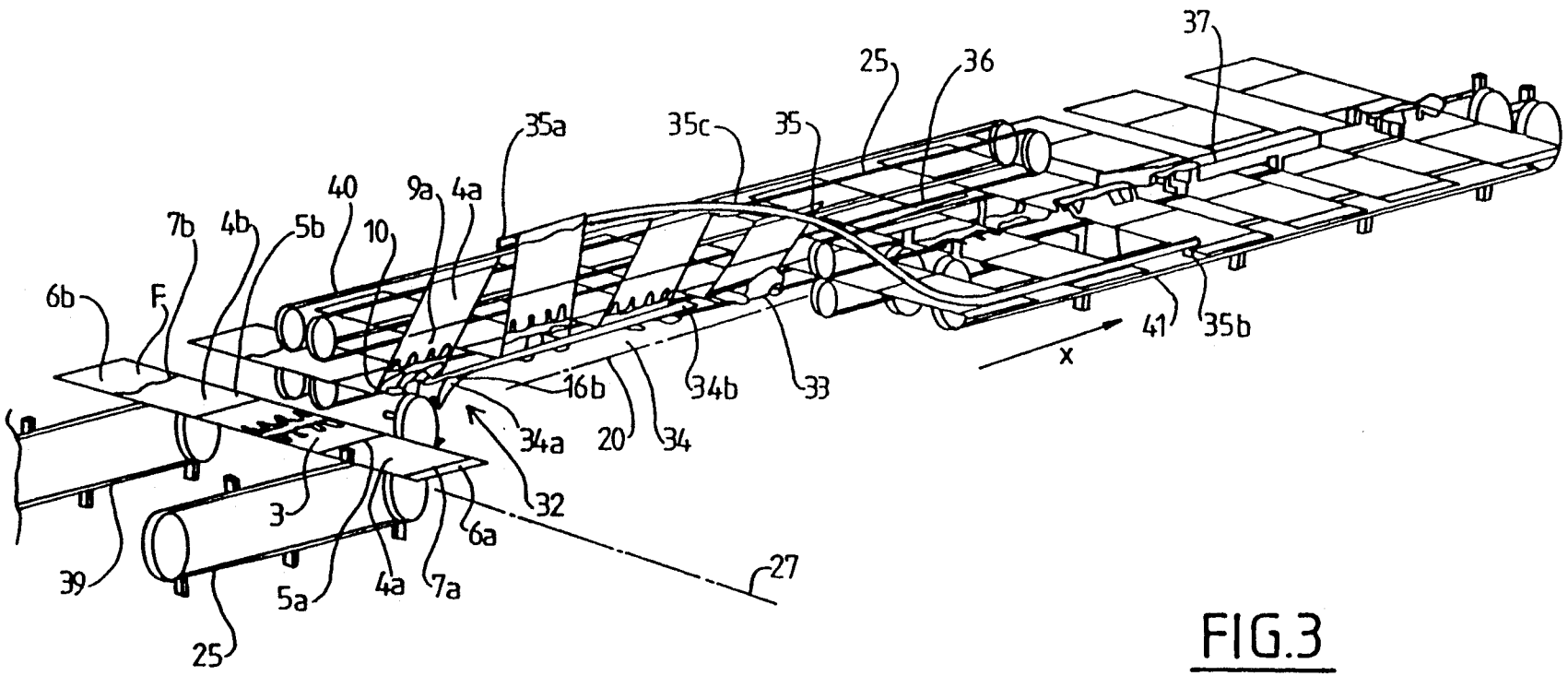
FIG. 3 is a partial perspective view of a device for forming a beam on a packing blank together with its functioning and of the method used, blanks being shown in several successive situations.
Figure 4:
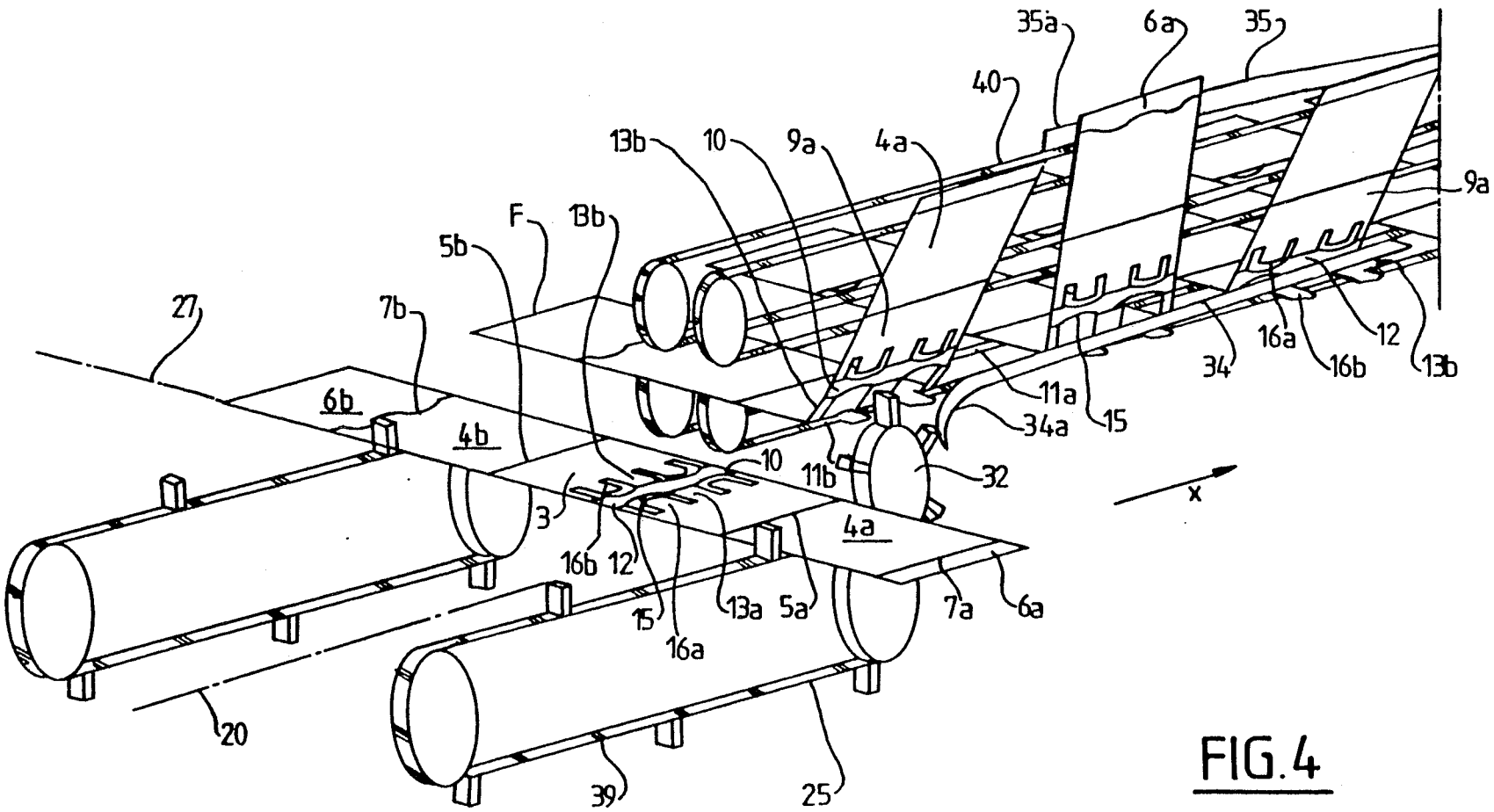
FIGS. 4, 5 and 6 are three partial perspective views, to a bigger scale, of the device in FIG. 3 showing more particularly the initial, intermediate and final phases respectively of the functioning of this device.
Figure 5:
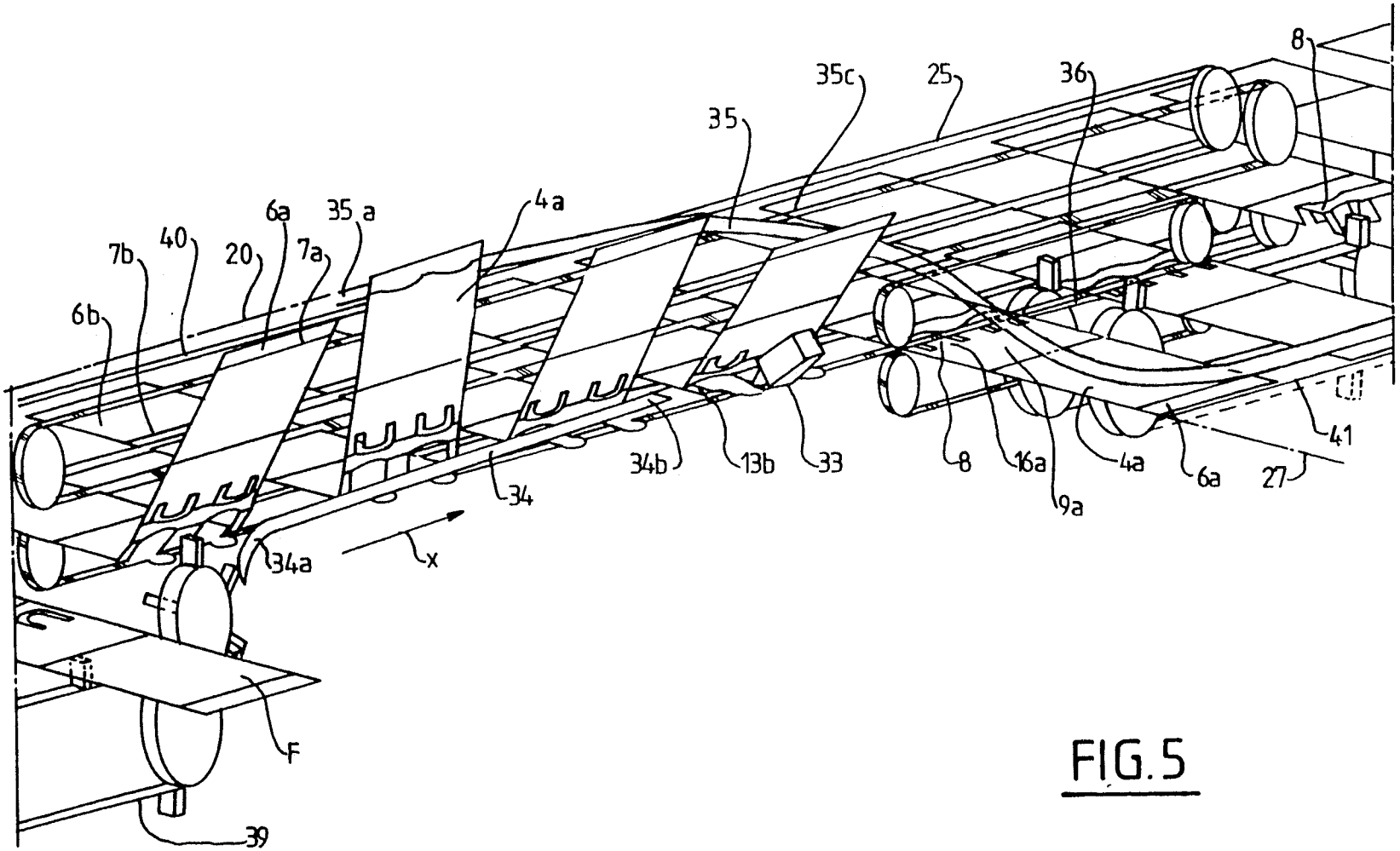
Figure 6:
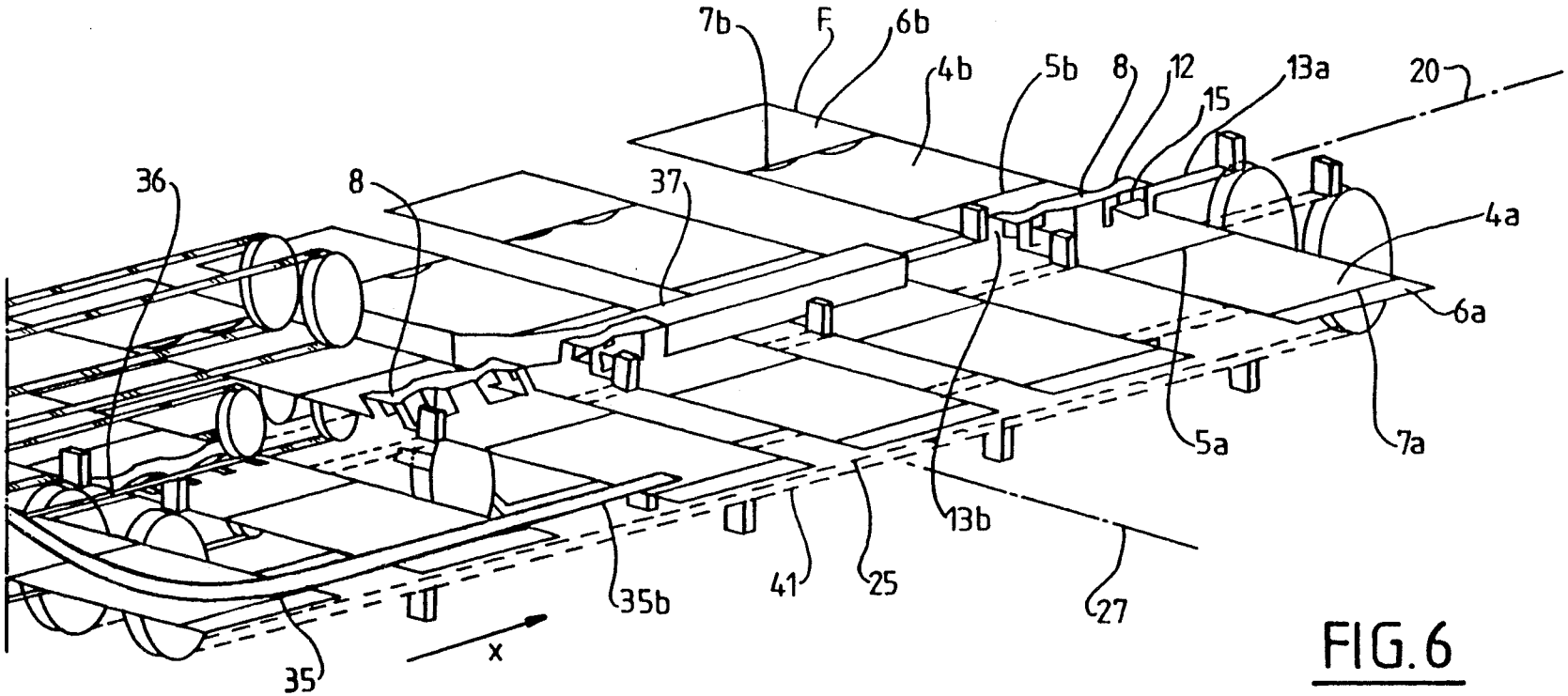

The invention relates to the production of a package 1 for cups or pots 2 such as thermoformed pots with lids for milk products. The pots 2 once packed are arranged in two rows R1, R2, and the package 1 surrounds them and forms a tubular jacket extending in a longitudinal direction. In order to facilitate the description, the following component parts (see FIGS. 3 and 4) are defined for the package 1:

(i) a base panel 3;

(ii) lateral panels 4*a*, 4*b* (two in the case of the figures) connected to the base panel 3 on either side of the latter by longitudinal folding lines 5*a*, 5*b*;

(iii) upper panels 6*a*, 6*b*, (two in the case of the figures) connected to the lateral panels 4*a*, 4*b*, by other longitudinal folding lines 7*a*, 7*b*.

Figure 1:
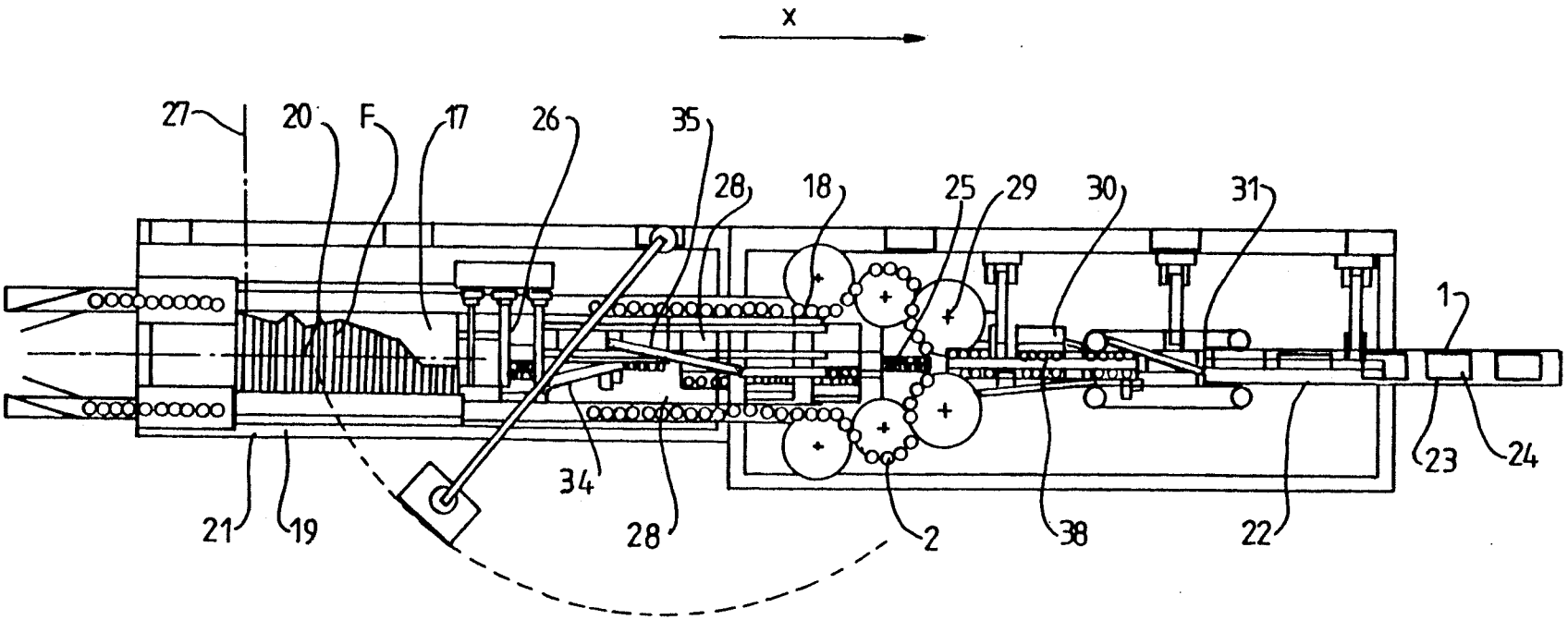
FIG. 1 is a diagrammatic plan view of a machine for packing pots in a package forming a jacket with beam shaped protrusions for rigidifying and for positioning the pots.
Figure 2:
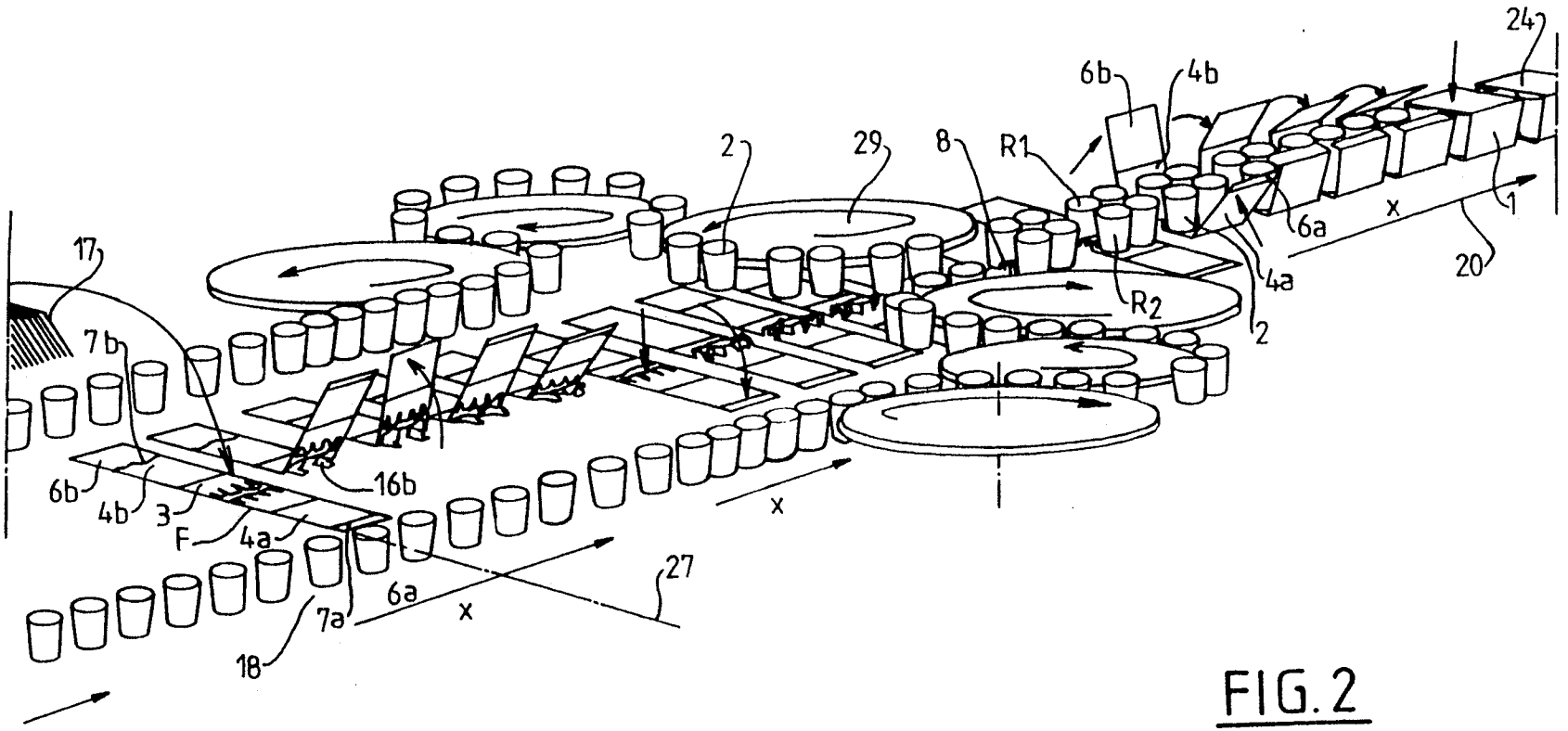
FIG. 2 is a perspective view illustrating the functioning of the machine in FIG. 1, the blanks and the pots being shown in several successive situations.

The base panel 3 has projections for rigidifying and for positioning the pots 2 (see FIG. 1) in the form of a median longitudinal beam 8.

The upper panels 6*a*, 6*b* mutually overlap and are rigidly joined together, by pasting in the described example. One of them 6*a* can be narrow in order to constitute an internal pasting tab and the other 6*b*, wide in order to constitute the outer panel of the package 1.

Figure 7A:
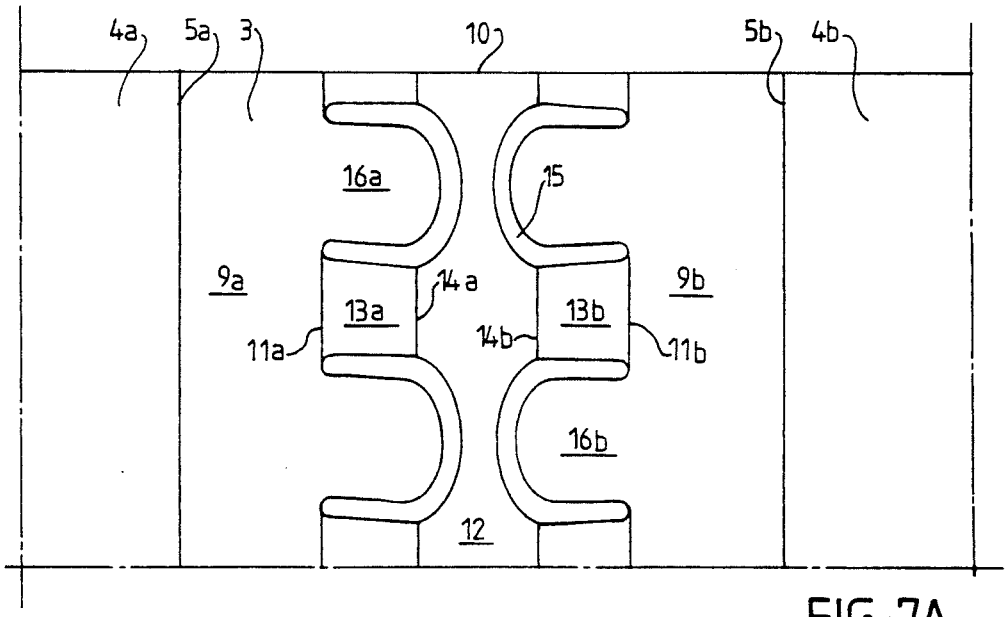
FIGS. 7A and 7B are two partial plan views of the blank used unfolded and flat and without a constituted beam (FIG. 7A) and with a constituted beam (FIG. 7B) respectively.

On the base panel 3, when the package 1 is unfolded and flat and the beam 8 not formed (FIG. 7A), the following parts are defined:

(i) a first lateral part and a second lateral part, 9*a* and 9*b*, adjoining the folding lines 5*a* and 5*b* respectively;

(ii) a median part 10 located between the two lateral parts 9*a*, 9*b* and articulated with the latter about the longitudinal folding lines 11*a*, 11*b*, itself comprising:

A) a longitudinally continuous central zone 12;

B) a first lateral zone and a second lateral zone 13*a*, 13*b*, respectively articulated on the one hand about the lines 11*a*, 11*b* and on the other hand in the central zone 12 about the longitudinal folding lines 14*a*, 14*b*. Each lateral zone 13*a*, 13*b* is in several sections separated by cutouts 15. The cutouts and the portions of lateral zones are, for the two lateral zones 13*a* and 13*b* situated respectively opposite each other in pairs.

C) A same plurality of first and second tabs 16*a*, 16*b*, opposite each other in pairs, arising from the cutouts 15, extend the lateral parts 9*a*, 9*b* beyond the lines 11*a*, 11*b*, and towards the central zone 12.

Figure 7B:
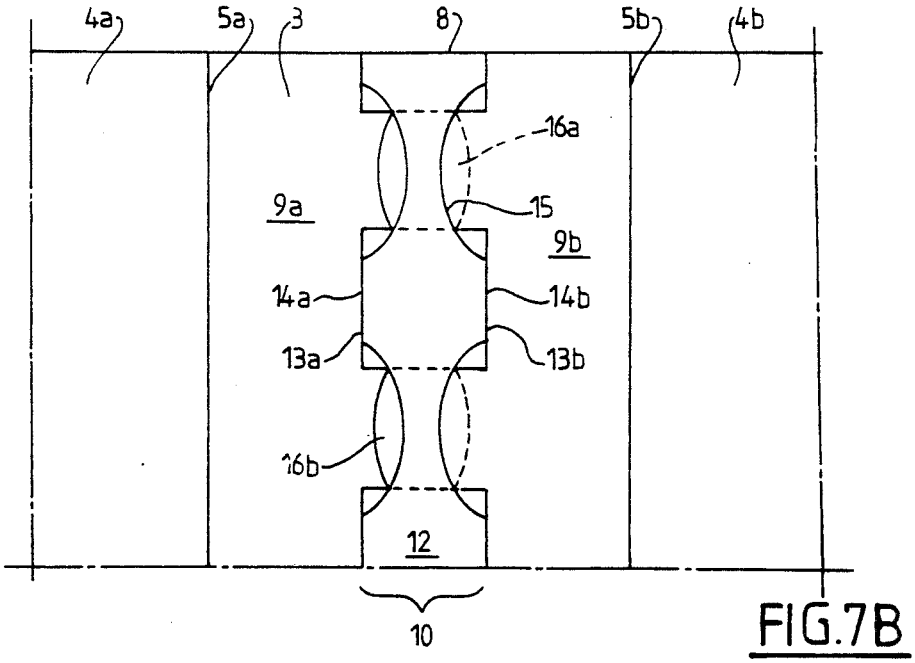

When the beam 8 is formed (FIG. 7*b*), the lateral sections 9*a*, 9*b* are coplanar with the tabs 16*a*, 16*b* which are superimposed and joined together; the lateral zones 13*a*, 13*b*, are projecting from the plane of the lateral sections 9*a*, 9*b* (for example at about 90°; the central zone 12 is transversely separated from this plane and situated opposite the tabs 16*a* and 16*b*.

In the package 1, the pots 2 stand on their bases on the full lateral sections 9*a*, 9*b*. Their side walls are, toward the interior, guided by the free edges of the cutouts 15 of the central zone 12. The upper panels 6*a*, 6*b* are placed against their lids. The side panels 4*a*, 4*b* are placed against their lateral walls toward the exterior.

A machine according to the invention (FIG. 1) allows the packaging of pots 2 in a package 1 such as described from, on the one hand a stock of unfolded and flat blanks F, with unconstituted beams 8, stacked in a magazine, being part of the blank feed means 17 and on the other hand, from a supply 18 of pots.

Such a machine comprises a frame 19 extending on the ground along a generally longitudinal and horizontal direction 20. The machine comprises towards one upstream end 21, supply means 17 and the supply 18 and, towards the opposite downstream end 22 an output conveyer 23, for packets 24 constituted of groups of pots 2 surrounded by packages 1. On the frame 19 and along the longitudinal direction 20 extend transfer means 25.

The transfer means 25 are preferably continuously functioning means but can also function in stepping mode. During functioning and with regard to their active parts, they are driven with a generally sliding motion along the longitudinal direction 20 and in a certain sense (from left to right in the figures, as indicated by the arrow X). This sense X allows the definition of the "upstream" and "downstream" positions and the "before" and "after" situations to which reference is made.

The transfer means 25 are associated, toward the upstream end, with the blanks magazine and with a device 26 for the extraction and depositing of blanks, one by one, on the transfer means 25 in a generally horizontal situation with the folding lines 5*a*, 5*b*, 7*a*, 7*b*, 11*a*, 11*b*, 14*a*, 14*b* parallel to the longitudinal direction 20 and the tabs 16*a*, 16*b*, directed horizontally and, parallel to a general direction 27 called the transverse direction with which the free edges of the blanks F are also parallel. Toward the downstream end, the transfer means 25 are associated with the conveyor 23. Between them, and from upstream to downstream, the following are associated with the transfer means 25:

a device 28 for folding and erecting the beam shaped protrusions for rigidifying and for positioning pots 2;

means 29 for bringing the pots into a location close to the transfer means 25 in order to bring the pots 2 onto the base panels 3 while being adjacent and on either side of the beam 8;

means 30 for folding the lateral panels 4*a*, 4*b* to a generally erected position and against the pots 2;

means 31 for folding and mutual joining together of the upper panels 6*a*, 6*b*.

The blanks magazine can receive the blanks placed one by one in a vertical plane with the folding lines vertical, the stack extending horizontally. The extraction device 26 can comprise moving arms and suction cups. The means 29 for bringing pots can comprise two symmetrical assemblies on either side of the transfer means 25, each having several notched drive wheels, capable of linking up with the transfer means 25 in order to deposit a suitable group of pots 2 on a blank F driven by the transfer means and being opposite.

The device 28 for folding and erecting the beam 8 comprises (FIGS. 3 to 6), placed from upstream to downstream along the transfer means 25:

an initial station 32 for folding by about a quarter of a turn in a first direction in order to bring the first lateral part 9*a* and the median part 10 into a generally erected position and to thus release the second tabs 16*b*;

a tab pasting station 33;

a second station 34 for folding by about a quarter of a turn in the first direction in order to bring the second lateral zone 13*b* into a generally horizontal position over the second lateral part 9*b*. The second station 34 is placed downstream of the first station 32;

a third station 35 for folding by about a quarter of a turn in a second direction in order to bring the first lateral part 9*a*, the central zone 12 and the first lateral zone 13*a* into a generally horizontal position, the first tabs 16*a* coming into contact with the second tabs 16*b*;

a station 36 for the mutual pressing of the first and second tabs 16*a*, 16*b*, essentially located toward the downstream end 35*b* of the third station 35;

a fourth and final station 37 for folding by about a quarter of a turn in the second direction in order to bring the two lateral zones 13*a*, 13*b* into a generally vertical position.

It must be understood that the concept of folding "by a quarter of a turn" is not limitative. It allows it to be understood that with respect to an initial position where two parts of the blank are substantially coplanar, they form, after the said folding by about a quarter of a turn, an angle such that one of the parts protrudes with respect to the plane of the other. However, the final angle between the two parts can be substantially smaller or greater than 90°, for example it can be between 45° and about 135°.

The machine furthermore comprises means 38 for pressing the pots 2 on the blanks F in order to ensure the maintaining of their relative positions, extending between the means 29 of bringing pots and the means 31 of folding and joining together.

The concept of "station" such as envisaged here relates to a group of functional means intended for carrying out the respectively intended functions of folding, pasting and pressing, these various means being able to more or less overlap each other and to extend more or less along the longitudinal direction 20.

In particular, in the machine shown in the figures, the second and third folding stations 34, 35 partially overlap, the respective foldings performed being partly concomitant, the upstream end 34*a* of the second folding station 34 being located at most upstream 35*a* of the third folding station and the downstream end 34*b* of the second folding station 34 being located at most downstream 35*b* of the third folding station 35. From upstream to downstream there is consequently encountered the second folding station 34; then the second and third stations 34, 35 together; and, finally, the third station 35 alone. The pasting station 33 is for its part located downstream of the downstream end 34*b* of the second folding station 34 and on the third folding station 35 but separated from its downstream end 35*b*, in particular in its median part 35*c*.

According to other variant embodiments which are not shown, the stations are not overlapping and are even separated from each other along the longitudinal direction 20. Possibly the pasting station 33 is located between the first and second folding stations 32, 34.

The transfer means 25 comprise, in the case of the machine shown, several sections arranged to allow the passage and the taking between them of the blanks F, and are therefore generally situated with respect to each other in such a way as to follow each other, with suitable junctions, along the longitudinal direction 20. All of the sections thus arranged operate in synchronism and in a coordinated manner and constitute the transfer means 25. These sections are, from upstream to downstream:

A preliminary section 39 close to the extraction device 26, receiving the blanks F coming from the blanks magazine. This preliminary section comprises, for example, one or more endless belts (or equivalent) with spaced pusher pegs capable on the one hand of receiving and supporting the blanks and, on the other hand, of pushing them by their free upstream transverse edge.

A first section 40 placed toward the upstream end and following the preliminary section 39, along which are placed the stations 32, 33, 34, 35 and 36. This first section 40 comprises pressure units capable of providing the positive holding and driving of the blanks F, of not preventing access to the median part 10 of the blanks, of not preventing the foldings taking place in the first, second and third stations 32, 34, 35. For example the first section 40 comprises one or more pairs of endless friction bands applied firmly against the two opposite surfaces, top and bottom, of the second lateral panel 4*b* and/or of the second upper panel 6*b*. For this purpose, such endless bands are laterally offset with respect to the median longitudinal direction where the median part 10 is located and on the opposite side where the folding and erection device 28 is located.

A second section 41 placed toward the downstream end, taking over from the first section 40 toward the downstream end, along which are placed the stations 36 and 37. Such a second section can be of the same general type as the preliminary section. The belts with pusher pegs being in the vicinity of but separated from the median part 10 of the blanks in order not to prevent the deployment of the beam 8. This same second section 41 is extended toward the downstream end up to the conveyer 23 or, as a variant, a final section taking over from the second section 41. Along the extension of the second section 41 toward the downstream end or the final section are placed the means for bringing 29, of folding 30 and of folding and joining together 31. In this downstream section, the second section 41 or the final section has a structure capable of receiving not only the blanks F but also the pots 2 carried by the latter and also of containing the forces applied by the folding and joining together means 30, 31, and the pressing means 38.

The stations, 32, 33, 34, 35, 36 and 37 can be the subject of different variant embodiments. In the case of the machine shown in the figures the first station 32 comprises a wheel with pins and having a horizontal transverse axis, driven in rotation about its axis, placed below the sliding plane of the blanks F defined by the transfer means 25, the pins making contact with the median part 10. The pasting station 33 comprises pasting means located above and in the vicinity of the transfer means 25, directed downward, capable of pasting the upper surfaces of the second tabs 16*b*. These pasting means such as a gun are located after the second station 34, on the third station 35 and the first section 40, before the second section 41. The second station 34 comprises a fixed deflection rail placed just above and in the proximity of the sliding plane of the blanks, extending in a longitudinal direction, in the extension of the wheel with pins of the first station 32 while approaching the first section 40 of the transfer means 25 placed facing and from upstream to downstream in such a way as to interfere with the median part 10. The third station 35 comprises a fixed ramp having a general elbowbend shape and which from upstream to downstream changes from a location above and substantially plumb with the deflection rail of the second station 34 to a location close to the sliding plane of the blanks F but separated laterally towards the exterior in such a way as to then work in conjunction with the first lateral panel 4*a* or the first upper panel 6*a*. The pressing station 36 comprises two horizontal endless moving bands stretched between two pairs of wheels having transverse axes, the two active sections of the bands being applied against each other or close to each other in order to be able to trap between them the pairs of tabs 16*a*, 16*b* for the time necessary to join them together by means of the previously deposited paste. The folding station 37 comprises a shaper in the form of a fixed ramp making contact with the beam 8 in order to ensure its deployment.

The folding means 30 of the lateral panels comprise two vertical wheels with transverse axes placed on either side of the extension of the second section 41 or of the final section. The means 31 for folding and joining together comprise two horizontal wheels with vertical axes offset with respect to each other along the longitudinal direction 20, distanced in the upward direction with respect to the transfer means 25. The means 38 for pressing comprise one or more moving horizontal endless bands stretched between two pairs of wheels with transverse axes, whose active sections are separated from the transfer means 25 while being placed above.

The invention also relates to a device for producing a beam 8 on a packing blank F which comprises, as has already been described, the blank feed means 17 and the stations 32, 33, 34, 35 and 36. At the output of such a device, deprived of the station 37 for deployment of the beam 8, the latter is folded on the blank F.

Such a device can be incorporated in an installation for the packaging of pots 2 such as already described comprising, in addition to this device, a device for packing pots 2 with the blanks thus prepared, associated with the latter by means of bringing blanks each having a median beam folded flat, comprising:

a) mobile means for the horizontal transfer of such successive blanks such as the means 25;

and, associated from upstream to downstream along the transfer means:

b) a device for erecting the beam such as the station 37;

c) means 19 for bringing two series of pots operating in synchronism with the transfer means from a supply of pots such as 18 to a location close to the transfer means 25 in order to bring the pots to be on the adjacent base panels 3 and on either side of the beam 8;

d) means for folding lateral panels 4*a*, 4*b* to a generally erected position against the pots, such as 30;

e) means for folding and for joining together upper panels such as 31;

The invention also relates to the method for producing a beam 8 protruding from a packing blank F in which:

firstly a relative folding by about at least a quarter of a turn is carried out in a first direction of the first lateral part 9*a* and of the median part 10 and second tabs 16*b* are released;

the tabs 16*b* are then pasted;

a relative folding by about at least a quarter of a turn is carried out in the same first direction in order to bring the second lateral zone 13*b* over the second lateral part 9*b;* a relative folding by about at least a quarter of a turn is carried out in a second direction opposite to the first direction in order to bring the first tabs 16*a* into contact with the second tabs 16*b;* the first and second tabs 16*a*, 16*b* are mutually pressed together;

a relative folding by about at least a quarter of a turn is carried out in the second direction in order to erect the two lateral zones 13*a*, 13*b* with respect to the two lateral parts.

I claim:

1. A machine for packing pots in two rows in a package forming a jacket, which jacket comprises a base panel having protrusions for rigidifying and for positioning the pots, two lateral panels, two upper panels rigidly joined; said base panel having first tabs, second tabs, a first lateral part, a second lateral part and a median part having a first lateral zone, a second lateral zone and a central zone; said machine comprising means for feeding packing blanks and means for transferring the blanks; a device for folding, erecting, rigidifying and positioning protrusions comprising a first station for folding a majority of said base panel by about a quarter of a turn in a first direction to the second lateral part to separate the second tabs from the plane of the majority of the base panel, a tab pasting station, a second station for folding said base panel by about another quarter of a turn in the first direction, a third station for folding said base panel by about a quarter of a turn in a second direction, a mutual pressing station, a fourth station for folding said base panel about another quarter of a turn in the second direction; means for bringing two series of pots onto the base panel; means for folding said lateral panels; and means for folding and for joining together said upper panels.

2. A machine according to claim 1, wherein the machine comprises further means for pressing the pots on the blanks in order to ensure the maintaining of their relative positions, said means for pressing being located between said means for bringing pots and said means for folding and joining together the upper panels.

3. A machine according to claim 1, wherein the pasting station is located downstream of a downstream end of the second folding station and on the third folding station, distanced from said downstream end.

4. A machine according to claim 1, wherein an upstream end of the second folding station may be located upstream of the third folding station and a downstream end of the second folding station may be located downstream of the third folding station.

5. A machine according to claim 4, wherein the second and third folding stations are at least partially overlapping, the respective foldings carried out being at least partly concomitant.

6. A machine according to claim 1, wherein the pasting station comprises pasting means located above and in the vicinity of the transfer means, said pasting means being directed downward and being capable of pasting upper surfaces of the second tabs.

7. A machine according to claim 1, wherein the transfer means comprise a first section placed toward an upstream end and a second section placed toward a downstream end; the first section comprising devices for applying pressure to the blanks capable of ensuring their positive relative holding and being laterally offset on a side opposite the side of the blank where the folding device is located; the second section comprising blank pushing devices.

8. A device for producing a beam on a packing blank having a base panel having first and second tabs, a first lateral part, a second lateral part and a median part having a first lateral zone, a second lateral zone and a central zone; said device comprises means for feeding unfolded flat packing blanks; mobile means for horizontal transfer of successive blanks; and, associated along the mobile means, a first station for folding by about a quarter of a turn in a first direction in order to bring a first lateral part and a median part of a base panel of the blank into a generally erected position relative to the second lateral part and to, thus, release second tabs extending from the second lateral part from a plane of the median part, a tab pasting station, a second station for folding by about an additional quarter of a turn in the first direction in order to bring the second lateral zone of the median part into a generally horizontal position over the second lateral part, a third station for folding by about a quarter of a turn in a second direction in order to bring the first lateral part, the central zone and the first lateral zone of the median part into a generally horizontal position with the first tabs coming into contact with the second tabs, and a final station for the mutual pressing of the first and second tabs together.

9. A device according to claim 8, wherein said second station maintains the first lateral part, the central zone and first lateral zone in the generally erected position.

10. An installation, for packing pots arranged in two rows, in a package forming a jacket, which comprises connected to each other by longitudinal folding lines, a base panel having a rigidifying and pot positioning beam, adjoining lateral panels, adjoining upper panels for covering and rigidly joined together, said installation comprising a first device for producing a beam on a packing blank, said base panel of said blank having first tabs, second tabs, a first lateral part, a second lateral part and a median part having a first lateral zone, a second lateral zone and a central zone, said first device comprises means for feeding unfolded flat packing blanks, mobile means for horizontal transfer of successive blanks, and, associated along the mobile means, a first station for folding by about a quarter of a turn in a first direction in order to bring a first lateral part and a median part of a base panel of the blank into a generally erected position relative to the second lateral part and to, thus, release the second tabs extending from the second lateral part from a plane of the median part of said base panel, a tab pasting station, a second station for folding by about an additional quarter of a turn in the first direction in order to bring a second lateral zone of the median part into a generally horizontal position over the second lateral part while maintaining the central zone, first lateral zone and first lateral part in the erected position, a third station for folding by about a quarter of a turn in a second direction in order to bring the first lateral part, the central zone and the first lateral zone of the median part into a generally horizontal position with the first tabs coming into contact with the second tabs, and a final station for the mutual pressing of the first and second tabs together; and a second device for packing pots with the blanks prepared by said first device and for producing a beam produced by the first device by means for bringing blanks each having a median beam folded flat, comprising mobile means for the horizontal transfer of successive blanks, and, associated from upstream to downstream along the mobile means, a device for erecting the beam, means for bringing two series of pots operating in synchronism with the mobile means from a supply of pots to a location close to the mobile means in order to bring the pots to be on adjacent sides of the base panel and on either side of the beam, means for folding lateral panels to a generally erected position against the pots, and means for folding and for joining together the upper panels.

11. A method for producing a beam projecting from a packing blank, said method comprising the steps of providing a blank having a base panel having first and second tabs, a first and a second lateral parts and a median part having first and second lateral zones and a central zone, relative folding by about a quarter of a turn in a first direction the first lateral part and the median part of a base panel relative to the second lateral part to release the second tabs from a plane of the median part, applying paste to the second tabs, relative folding by about another quarter of a turn in the same first direction in order to bring a second lateral zone of the median part over the second lateral part without further folding the central zone, relative folding by about a quarter of a turn in a second direction opposite to the first direction in order to bring the first tabs into contact with the second tabs, pressing the first and second tabs mutually together, then relative folding by about another quarter of a turn in the second direction in order to erect the two lateral zones with respect to the two lateral parts.

* * * * *